US010724484B2

(12) United States Patent
Pereira et al.

(10) Patent No.: US 10,724,484 B2
(45) Date of Patent: Jul. 28, 2020

(54) DIGITAL INLET VALVE

(71) Applicant: DELPHI TECHNOLOGIES IP LIMITED, St. Michael (BB)

(72) Inventors: Etienne Pereira, Cande-sur-Beuvron (FR); Alexis Menand, Blois (FR); Jérôme Simon, Vineuil (FR); Christophe Breant, Saint Sulpice de Pommeray (FR)

(73) Assignee: DELPHI TECHNOLOGIES IP LIMITED (BB)

( * ) Notice: Subject to any disclaimer, the term of this patent is extended or adjusted under 35 U.S.C. 154(b) by 281 days.

(21) Appl. No.: 15/769,552

(22) PCT Filed: Oct. 10, 2016

(86) PCT No.: PCT/EP2016/074240
§ 371 (c)(1),
(2) Date: Apr. 19, 2018

(87) PCT Pub. No.: WO2017/067811
PCT Pub. Date: Apr. 27, 2017

(65) Prior Publication Data

US 2018/0313315 A1 Nov. 1, 2018

(30) Foreign Application Priority Data

Oct. 19, 2015 (GB) ..... 1518455.9

(51) Int. Cl.
*F02M 59/00* (2006.01)
*F02M 59/46* (2006.01)
*F02M 59/36* (2006.01)
*F02M 63/00* (2006.01)
*F02M 59/48* (2006.01)

(52) U.S. Cl.
CPC ..... *F02M 59/466* (2013.01); *F02M 59/368* (2013.01); *F02M 59/48* (2013.01); *F02M 59/485* (2013.01); *F02M 63/0021* (2013.01); *F02M 63/0022* (2013.01); *F02M 63/0071* (2013.01)

(58) Field of Classification Search
CPC ..... F02M 59/466; F02M 59/368
USPC ..... 335/55
See application file for complete search history.

(56) References Cited

U.S. PATENT DOCUMENTS 6,161,813 A 12/2000 Baumgartner et al.
6,279,542 B1 * 8/2001 Lindblom ..... F02M 59/366 123/506
6,315,531 B1 * 11/2001 Schwarz ..... F02M 59/366 251/129.16
2001/0048091 A1 12/2001 Enomoto et al.
2007/0200655 A1 8/2007 Murakami et al.
2011/0049406 A1 3/2011 Boeland et al.
(Continued)

FOREIGN PATENT DOCUMENTS

CN 1397726 A 2/2003
CN 203770000 U 8/2014
(Continued)

*Primary Examiner* — Alexander Talpalatski
(74) *Attorney, Agent, or Firm* — Joshua M. Haines

(57) ABSTRACT

A digital inlet valve is the complementary assembly of an armature module, a body module and an actuation module enabling direct control over an air gap between a magnetic armature and a pole piece body.

17 Claims, 5 Drawing Sheets

(56) References Cited

U.S. PATENT DOCUMENTS

| | | | |
|---|---|---|---|
| 2014/0103243 | A1 | 4/2014 | Van Himme et al. |
| 2015/0198126 | A1 | 7/2015 | Marechal et al. |
| 2018/0045154 | A1 | 2/2018 | Bueser et al. |

FOREIGN PATENT DOCUMENTS

| | | | |
|---|---|---|---|
| DE | 102012201413 | A1 | 8/2013 |
| EP | 844385 | A1 | 5/1998 |
| WO | 2006108742 | A1 | 10/2006 |
| WO | 2016131644 | A1 | 8/2016 |

* cited by examiner

DIGITAL INLET VALVE

CROSS REFERENCE TO RELATED APPLICATIONS

This application is a national stage application under 35 USC 371 of PCT Application No. PCT/EP2016/074240 having an international filing date of Oct. 10, 2016, which is designated in the United States and which claimed the benefit of GB Patent Application No. 1518455.9 filed on Oct. 19, 2015, the entire disclosures of each are hereby incorporated by reference in their entirety.

TECHNICAL FIELD

The present invention relates to a digital inlet valve for metering the pressurized fuel expelled out of the pumping chamber of a high pressure pump.

BACKGROUND OF THE INVENTION

GB1502693 discloses an electromagnetic digital inlet valve, hereafter DIV, for controlling fuel inlet in a high pressure fuel pump of automotive fuel injection equipment. The pump is provided with a passive inlet valve member alternatively commuting between an open state and a closed state of the fuel inlet. The DIV cooperates with said valve member by forcing the valve member in the open position when the DIV is not energized and by removing any additional efforts on the valve member when the DIV is energized, letting in that latter situation the inlet valve member to operate on a passive mode as a function of fuel pressure in a compression chamber.

When energizing the DIV a magnetic armature translates and closes an air gap which dimensional accuracy is crucial to the performances of the DIV and of the pump. The DIV of the prior art is assembled piece by piece over the pump and, said air gap is the resultant of a chain of dimensions each being measured on a specific component. The manufacturing part-to-part dispersion and the accuracy achievable with this DIV of the prior art has become incompatible with nowadays performance requirements.

SUMMARY OF THE INVENTION

Accordingly, it is an object of the present invention to resolve the above mentioned problems in providing a DIV having modular design concept.

In a first aspect, the invention relates to a magnetic armature module of a digital inlet valve, hereafter DIV, also comprising a body module and an actuation module, the modules forming the DIV and cooperating, in use, with an inlet valve member of a fuel pump, the valve member commuting between an open state and a closed state to control the fuel inlet in a compression chamber of the pump.

Advantageously, the magnetic armature module comprises:

- a magnetic armature member having a cylindrical base portion and an elongated shaft, the shaft protruding from a top face of the base portion and extending along a main axis toward a distal end and,
- a tubular cylindrical sleeve having an outer cylindrical face axially extending from an under face to a top face, the sleeve also having an axial through bore opening in both faces, the sleeve being slidably arranged on the shaft engaged in said bore, the under face of the sleeve facing the top face of the base portion of the armature,

- a flange socket forming a spring seat provided with a disc-like flange portion radially extending from a central portion provided with an axial opening engaged and fixed on the shaft, the flange portion radially extending from the shaft and having an under face facing the top face of the sleeve and a top face adapted to receive a coil spring.

The flange is fixed in a position enabling the sleeve to freely translate along the shaft between a first extreme position where the under face of the sleeve abuts proximal to the top face of the armature base member and, a second extreme position where the top face of the sleeve abuts proximal to the under face of the spring seat.

This modular design of the DIV advantageously enables direct control of the air-gap.

In an alternative, the shaft is provided with a top portion having smaller diameter than the shaft diameter and creating a shoulder face against which the flange is positioned in abutment.

Also, the spring seat is press-fitted with interference on the shaft.

In an alternative, the cylindrical base portion and the elongated shaft are separate components the shaft being fixed onto the base portion.

In another alternative, the magnetic armature is monobloc, the elongated shaft being integral to the base portion.

In a second aspect, the invention is related to a body module of the DIV adapted to cooperate in use with a magnetic armature module previously presented. The body module comprises:

- a baseplate member having a transverse planar wall surrounded by a peripheral small wall, the transverse planar wall being provided with an axial through hole opening in an under face and in the an opposed top face of said planar wall and, the peripheral wall being adapted to position the DIV on a top face of the pump, the under face of the planar wall facing said pump top face and, the inlet valve member axially protruding out of said pump top face,
- a non-magnetic tubular ring having a cylindrical wall with outer and inner faces defining a central cylindrical passage, the wall axially extending from an under edge to a top edge, the under edge being fixed to the baseplate so the axial through hole of the baseplate is aligned with the central passage of the ring and,
- a magnetic cylindrical body having an outer cylindrical face axially extending from an under face to a top face, and being provided with an axial blind bore opening in the under face and axially extending inside the body toward a bottom end proximal to the top face, the under face of the body being fixed to the top edge of the ring so that the blind bore is axially X aligned with the axial through hole of the baseplate and the central passage of the ring.

Also, the cylindrical outer face of the body is in flush continuity with the outer face of the non-magnetic ring.

Also, the baseplate member, the tubular ring and the magnetic body are welded to each other.

In a third aspect, the invention is related to an armature-and-body module arrangement comprising the complementary assembly of a magnetic armature module previously presented with the body module also previously presented. Said armature-and-body module comprises:

- a coil spring is arranged in the blind bore proximal the bottom end of the bore and,
- the tubular cylindrical sleeve is inserted and fixed in the blind bore of magnetic cylindrical body so that, the coil spring is axially compressed in the blind bore between the bottom end of the bore and the spring seat, the coil spring biasing the armature module in the second extreme position.

In an embodiment the sleeve in press-fitted with interference in the blind bore.

In a fourth aspect, the invention is related to an actuation module of the DIV adapted to cooperate in use with an armature-and-body module assembly previously presented. The actuation module comprises:

an electrical solenoid fixed and enclosed inside a cover member, the solenoid generating, in use when energized, a magnetic field adapted to attract and to displace the magnetic armature.

The solenoid is toroidal defining a central opening adapted to be engaged over the body module, the non-magnetic ring being inside said central opening.

The wall of the cover member defines a multi-portion internal space adapted to receive the body module, a first top closed portion being shaped to complementary receive the magnetic cylindrical body, a second intermediate portion being shaped to complementary receive the solenoid and, a third open bottom portion being shaped for complementary engagement and fixation on a the baseplate.

In a fifth aspect, the invention is related to a digital inlet valve DIV comprising the complementary assembly of armature-and-body module enclosed inside an actuation module wherein the non-magnetic ring is centrally arranged in the solenoid and, the open third portion of the cover complementary arranged with the baseplate so that, in use, the DIV is able to bias open the inlet valve member by having the armature module in the first position and, when the solenoid is energized, the magnetic field attracts the armature module in the second extreme position further compressing the coil spring, the DIV enabling the fuel inlet to close.

The invention is also related to a method to assemble a magnetic armature module as previously presented. The method comprises the steps of:

a) providing the magnetic armature member, b) providing the tubular cylindrical sleeve, c) providing the flange socket, d) slidably engaging the sleeve on the elongated shaft of the armature, the under face of the sleeve facing the top face of the base portion of the armature, e) press-fitting the flange socket on said shaft by engaging the shaft through the axial opening of the central portion of the socket, the under face of the disc-like flange facing the top face of the sleeve, f) adjusting the position of the socket on the shaft so that a predetermined air-gap A is kept open between the under face of the flange and the top face of the sleeve or, between the under face of the sleeve and the top face of the armature member base portion.

The invention is also related to a method to assemble an armature-and-body module. The method comprises the steps of:

g) providing an armature module assembled as per the method claimed in claim, h) providing a body module as claimed in claim, i) assembling an armature-and-body module arrangement by:

j) presenting the armature module before the body module, the shaft being axially aligned with the blind bore, the spring seat being proximal to the blind bore opening, k) engaging the armature module by freely entering the spring seat in the bore, then by press-fitting with interference the sleeve in the bore so that, the coil spring is axially compressed between the blind end of the bore and the spring seat, the spring biasing the armature module in the first extreme position.

The invention is also related to a method to assemble a DIV. The method comprises the steps of:

l) providing an armature-and-body module assembled as per the method claimed in claim, m) providing an actuation module as claimed in claim, n) presenting the armature-and-body module before the actuation module, the magnetic cylindrical body facing the open bottom portion of the cover member, o) engaging the armature-and-body module into the actuation module, the magnetic cylindrical body adjusting in the first top closed portion of the cover member and, the non-magnetic ring adjusting in the central opening of the toroidal solenoid.

BRIEF DESCRIPTION OF THE DRAWINGS

The present invention is now described by way of example with reference to the accompanying drawings in which.

DESCRIPTION OF THE PREFERRED EMBODIMENTS

In an automotive vehicle, fuel at a few bars pressure flows from a low pressure tank to a fuel pump 10 part of an injection equipment. The fuel enters the pump 10 via an inlet 12 prior to be pressurised in a compression chamber 14 and to be flown via an outlet 16 toward fuel injectors adapted to spray fuel in combustion chambers of an internal combustion engine.

Although the invention can be implemented in many type of electromagnetic actuator utilized in multiple fields, it has been first thought as a digital inlet valve provided on a high pressure diesel fuel pump part of automotive diesel injection equipment.

Figure 1:
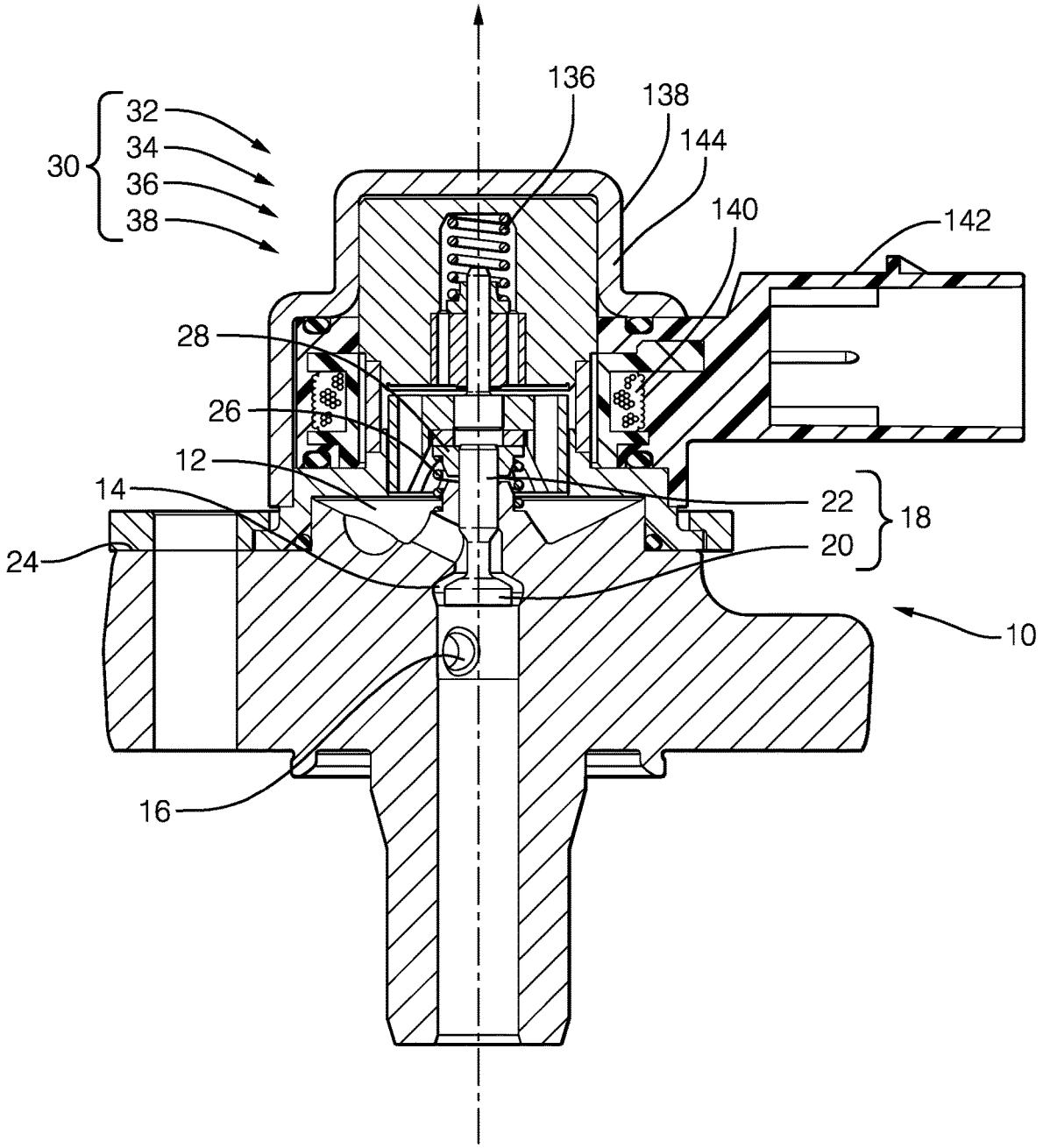
FIG. 1 is an axial section of a fuel pump provided with a digital inlet valve (DIV) as per the invention.
Figure 2:
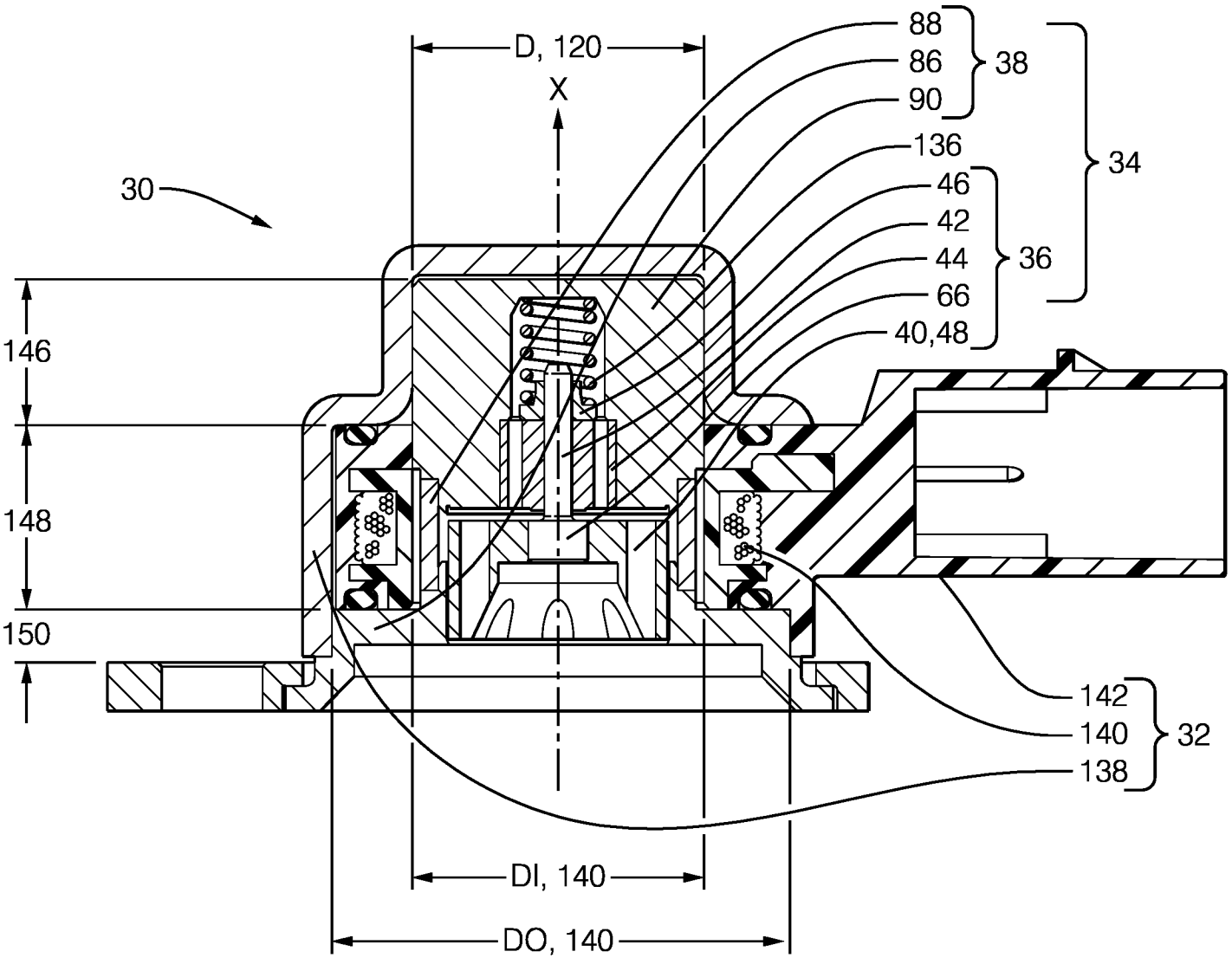
FIG. 2 is an axial section of the DIV of FIG. 1.

A well-known type of fuel pump 10, represented on FIG. 1, is provided with a piston shaft reciprocally translating along a pumping axis X in a blind bore defining the compression chamber 14 proximal the blind end of said bore. The inlet 12 is controlled by an inlet valve member 18 adapted to commute between an open state OS, enabling entry of fresh fuel in the compression chamber 14 and, a closed state CS forbidding such entry. Typically, the inlet valve member 18 is a passive valve meaning that it commutes under the influence of fuel pressure difference between the inlet channel and the compression chamber 14. The inlet valve member 18 commutes to the open state OS when the piston shaft sucks low pressure fuel in the compression chamber and, commutes back to the closed state CS when the piston initiates compression of said fuel.

The inlet valve member 18 is a poppet valve having a head 20 arranged at the top of the compression chamber 14 and having a stem 22 axially X extending through the body of the pump and protruding out of a top face 24 of said pump. A valve spring 26 compressed between a face of said top face 24 and a spring seat 28 fixed onto the stem 22 upwardly biases the inlet valve member 18 toward the closed state CS.

To ease and clarify the description, words such as "upwardly, top, under . . . " are utilised in reference to the arbitrary and non-limiting orientation of FIG. 1.

A digital inlet valve 30, hereafter abbreviated DIV, is an electromagnetic actuator arranged on the top face 24 of the pump, right above the inlet valve member 18 in order to cooperate with it.

Figure 3:
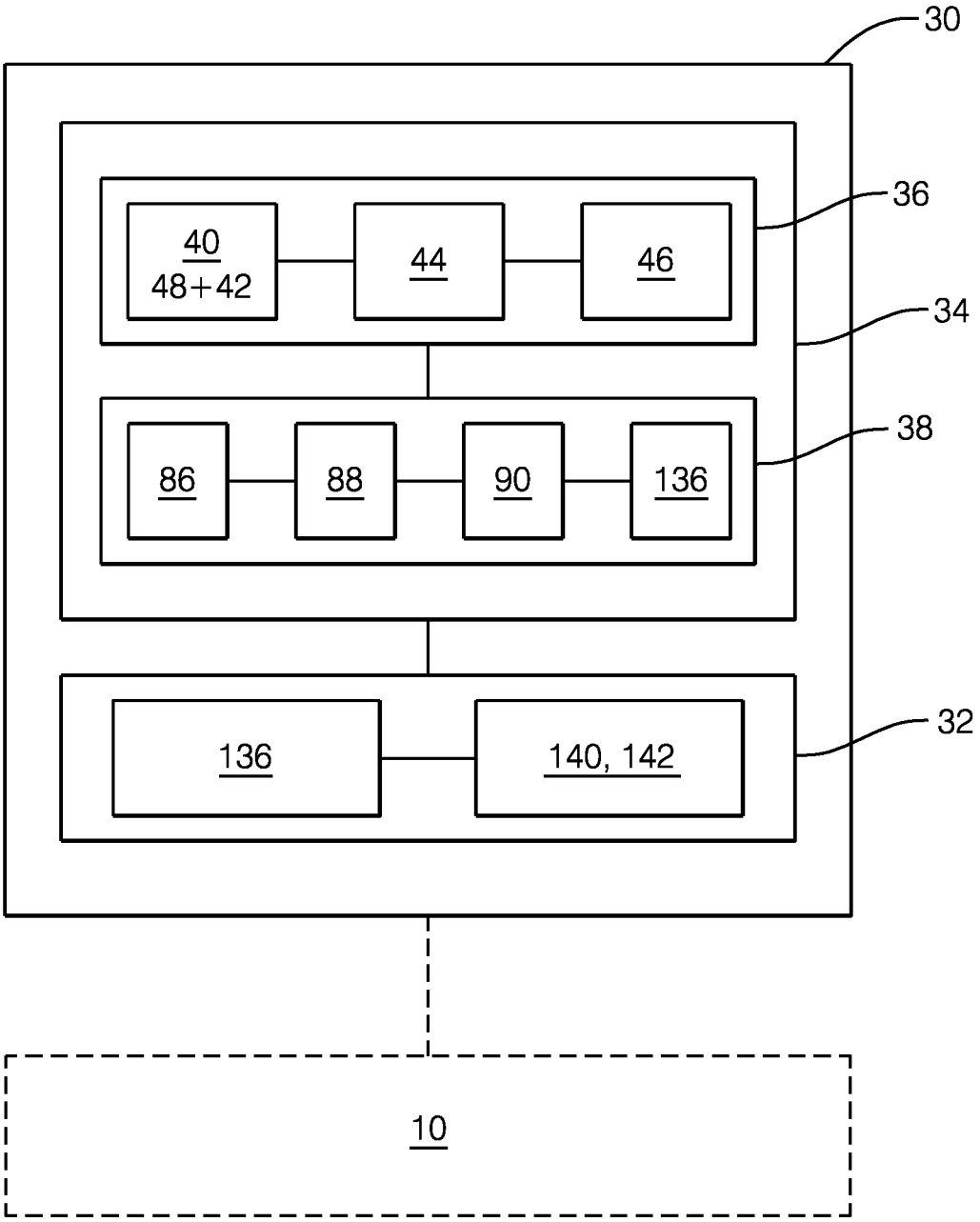
FIG. 3 is a block diagram of the DIV of FIG. 2.

The block diagram of FIG. 3 details the general structure of the DIV 30 which comprises an actuation module 32 cooperating with an armature-and-body module 34, itself comprising a magnetic armature module 36 cooperating with a body module 38. Each of the modules comprises specific that are assembled together to form the module and, once all modules are made available, they are assembled with each other to make the DIV.

Each module 32-38 is now described in reference to the FIGS. 4 to 10.

The armature module 36, now described in reference to FIGS. 4 to 7, comprises a magnetic armature 40, a shaft 42, a sleeve 44 and a flange socket forming spring seat 46.

The magnetic armature 40 comprises the fixed assembly of a cup-like cylindrical magnetic base portion 48 and of the elongated shaft 42. The base portion 48 has a top wall 50 defining a transverse top face 52, and a peripheral cylindrical wall 54 defining an outer face 56, having diameter D56, axially X extending from an under annular face 58 to the transverse top face 52. The walls 50, 54, define a deep recess 60 centrally opening in the under face 58 and having a transverse bottom face 62 proximal to the top face 52. A through bore 64 having an inner diameter D64 is axially pierced through the top wall 50 and opens in the bottom face 62 of the recess and in the top face 52 of the armature.

The bore 64 is preferably a through bore but, alternatively it could a blind bore, only opening in the top face 52.

Although not directly related to the present invention is worth mentioning that the armature base portion 48 is provided with several large channels 65 enabling, in use, fuel to flow and not to be compressed in either side of the armature.

In the context of this description, "transverse" explicitly designates directions perpendicular to the pumping axis X, a "transverse face" being normal to the axis X. Furthermore, "axial, axially . . . " refer to the direction of the pumping axis X.

The elongated shaft 42 extends along the pumping axis X, it is cylindrical having diameter D42 and it is provided at an extremity with a short head 66 having a larger diameter D66, slightly superior to the bore diameter D64, and an axial height substantially equal to the thickness of the top wall 48 of the armature.

Figure 4:
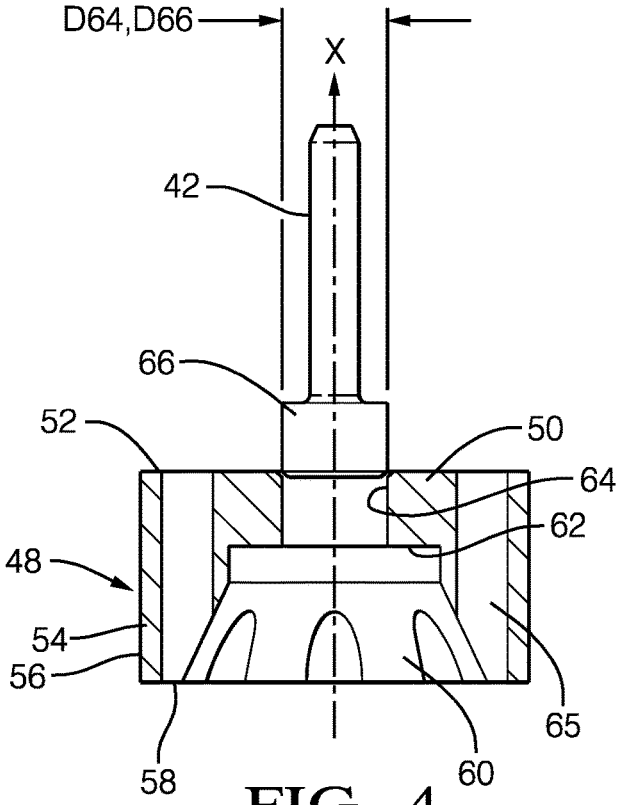
FIGS. 4, 5, 6 and 7 are steps of assembling an armature module of the DIV of FIGS. 1 to 3.
Figure 5:
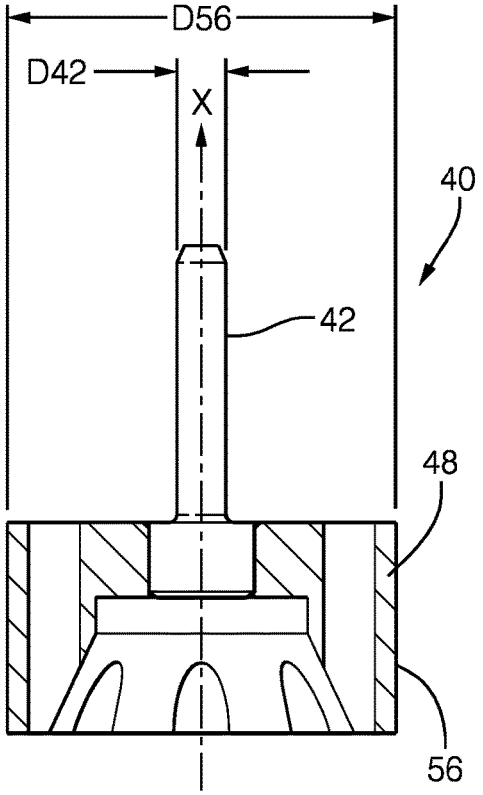

As shown in FIG. 4, the head 66 of the shaft is press-fitted with interference in the bore 64 of the armature. The interference of the press-fit is due to the slight difference between the diameters D64, D66 of the bore and of the shaft head. The person skilled in the art will easily determine said diameter difference in order for the shaft 42 to be permanently fixed in the armature 40 as well as other manufacturing details such as chamfers to avoid sharp edges. In FIG. 3, the shaft 42 is downwardly inserted in the base portion 48 but an upward assembly pushing the head 66 from the recess 60 is also possible.

To ensure perfect concentricity of the magnetic armature 40, a final manufacturing step of can be operated after assembling the shaft 42 into the armature base 48, for finalizing the diameters D42, D56, of the shaft and of the outer face 56 of the armature base portion and for ensuring perfect pendicularity of the shaft 42 relative to the armature base portion 48.

Alternatively, the head 66 could be of the exact same diameter as the rest of the shaft 42, or even with smaller diameter that the shaft, the principal of press-fit fixation remaining identical.

Other possible means of fixation are also known such as welding, which in this case would not require interference fit. Furthermore, in an alternative the shaft could be integral to the magnetic base portion forming a single monobloc armature.

The sleeve 44, now described, is a cylindrical member having a cylindrical outer face 68 with diameter D68 axially X extending from a transverse under face 70 to a transverse top face 72. In the alternative presented on the figures, it is visible that the outer cylindrical face 68 of the sleeve is provided with a central undercut. The sleeve 44 having purpose to be press-fitted with interference of this outer face 68, the undercut eases the manufacturing and the control of the diameter D68. The sleeve 44 is further provided with an axial through guiding bore 74 having diameter D74 and opening in both the under face 70 and the top face 72. Said diameter D74 is slightly larger than the shaft diameter D42 so the sleeve can be freely engaged on the shaft 42 and thereon slidably guided, the under face 70 of the sleeve facing the top face 52 of the armature.

Also, although not directly related to the invention, the sleeve 44 is provided with at least one channel parallel to the axis, said channel easing transfer of fuel on either side of the sleeve and not compressing fluid.

Figure 6:
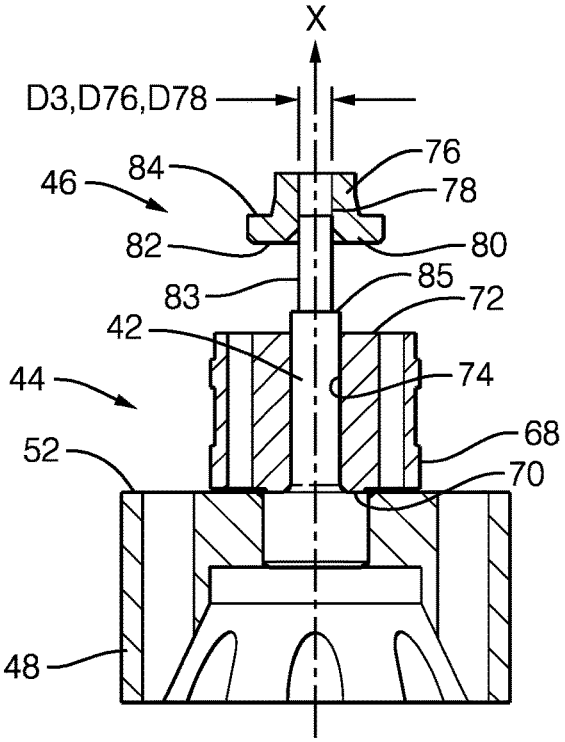
Figure 7:
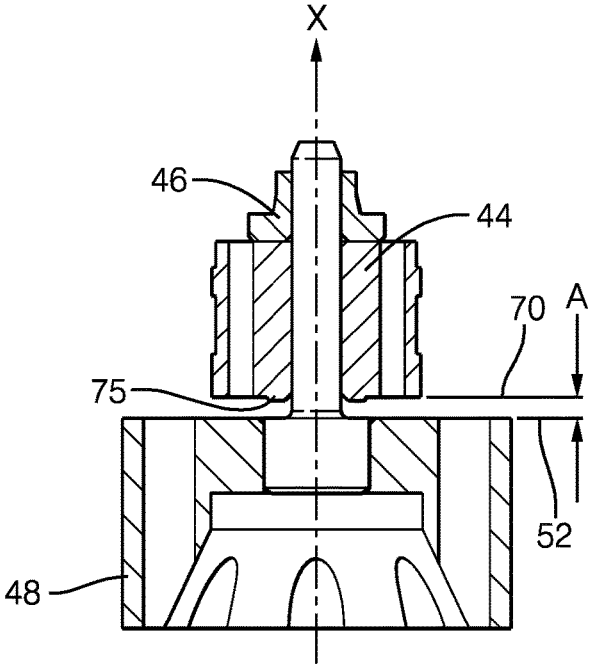

In the alternative presented on FIGS. 6 and 7, the sleeve 44 is provided on the under face 70 with a small annular protrusion 75 surrounding the opening of the bore 74. In the alternative presented where the shaft 42 is provided with a larger head 66, this annular protrusion 75 has an outer diameter slightly smaller than the shaft head diameter D66 so, in use, the abutment between the armature 40 and the sleeve 44 is done by said protrusion 75 contacting said head 66. This enables a compatible choice of materials minimizing hammering of the surfaces, details of this material choice is provided at the end of this description. Furthermore, since the displacements of the armature is due to a magnetic field M, this protrusion 75 minimizes the surfaces in contact when the magnetic field M is generated and therefore, it eases separation of the faces when the field non-longer applies.

Here again the person skilled in the art will easily determine the diameter D74 of the sleeve guiding bore relative to the diameter D42 of the shaft so that the shaft 42 is axially guided in the bore 74.

The flange socket forming spring seat 46, now described, comprises a cylindrical central portion 76 provided with an axial through opening 78 having diameter D78 slightly smaller than the shaft diameter D42. From said central portion 76 radially outwardly extends a transversal disc-like flange 80 having an external diameter D80, said flange having a transverse under face 82 and a transverse top face 84.

As shown on FIGS. 6 and 7, the spring seat 46 is engaged and press-fitted on the shaft 42, the under face 82 of the flange facing the top face 72 of the sleeve. As shown on FIG. 7, the engagement of the spring seat 46 onto the shaft 42 is stopped when the under face 82 of the flange is at a predetermined distance A from the top face 72, said distance being the air gap A of the DIV.

A major advantage of this DIV is that the air gap A which is a key feature of the DIV is directly chosen and is not the resultant of other dimensions. Such embodiment enables to accurately control the dimension on each part and it minimizes the part-to-part dispersion air in using an easy process.

In an alternative, represented on FIG. 6, the shaft 42 is provided in a top portion 83, opposite to the head 66, having a smaller diameter D83 than diameter D42. This creates a shoulder face 85 against which the spring seat 46 can be positioned in abutment. In this alternative the air-gap A is directly obtained by the manufactured location of said shoulder face 85 on the shaft 42.

Once again, the person skilled in the art will easily determine the socket's diameter D82 relative to the shaft diameter D42 in order for the spring seat 46 to be permanently fixed to the shaft 42. Also, to stop the spring seat insertion at the correct location, one can insert a shim having calibrated thickness A then, inserting the spring seat until the under face 82 abuts said shim. An alternative is to place the calibrated shim between the sleeve and the base of the armature and, insert the spring seat until the under face abuts the sleeve.

Also, as can be seen, the sleeve is free to slide between the armature and the spring seat. It has been described to firstly fix the shaft and lastly the spring seat. The opposite order is of course possible where the sleeve is firstly slidably engaged on the shaft, the spring seat is then press-fitted, this assembly being lastly fixed onto the magnetic base member.

Figure 8:
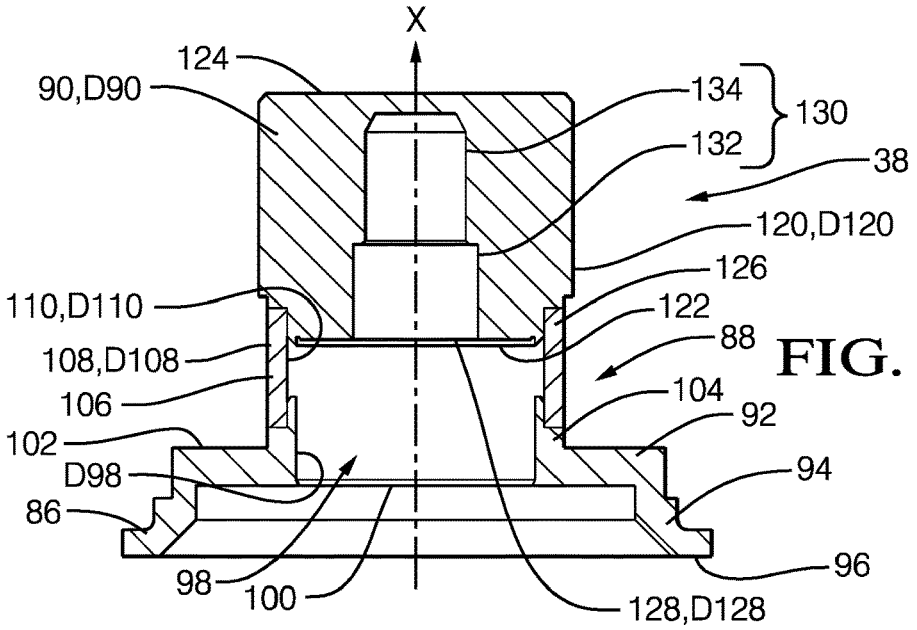
FIG. 8 is a body module of the DIV of FIGS. 1 to 3, FIGS. 9 and 10 are steps of assembling of the armature assembly of FIG. 7 into the body module of FIG. 8.
Figure 9:
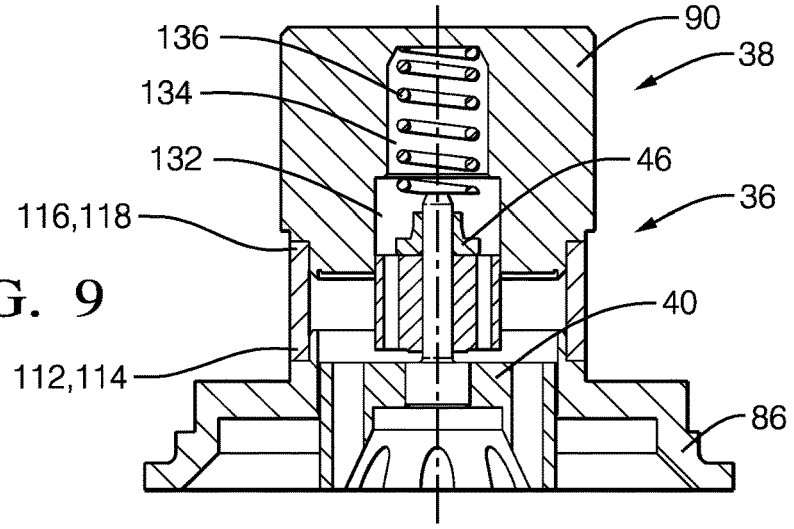
Figure 10:
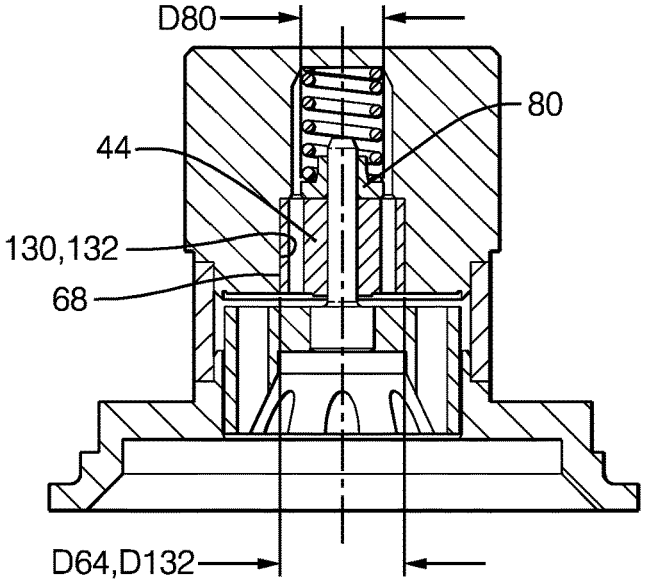

The body module 38, now described in reference to FIG. 8, comprises the coaxial X stack assembly of a magnetic baseplate 86, bottom of the figure, a non-magnetic annular ring 88 and of a magnetic cylindrical body 90, top of the figure.

The baseplate 86 has a transverse planar wall 92 from the outer edge of which perpendicularly depart a surrounding peripheral small wall 94 axially extending to an annular location face 96 adapted to abut the top face 24 of the pump. The transverse planar wall 92 is provided with an axial through hole 98 of diameter D98 opening in the transverse under face 100 and in the opposed transverse top face 102 of said planar wall 92. The opening of said hole 98 on the top face 102 is surrounded by an annular ring locating protrusion 104. As said above, the peripheral wall 94 is adapted to locate and fixe the DIV 30 on a top face 24 of the pump, the under face 100 of the planar wall facing said pump top face and, the inlet valve member 18 axially X protruding out of said pump top face. Consequently the exact geometry of said peripheral wall depends on the geometry of the top face 24 of the pump and may therefore vary from the representation of the figure.

The non-magnetic tubular ring 88, now described, has a cylindrical wall 106 defining and outer face 108 having outer diameter D108 and a parallel inner face 110 having inner diameter D110 defining a central cylindrical passage 112. The wall 106 axially extends from an under edge 112, having a profile 114 complementary to the profile of the annular locating protrusion 104 of the baseplate, to a top edge 116 also having a locating profile 118.

The magnetic cylindrical body 90, now described, is a cylindrical member having an outer peripheral face 120 of diameter D120 equal or smaller, as represented on the figures, to the outer diameter D108 of the ring. Said outer peripheral face 120 axially X extends from a transverse under face 122 to a transverse top face 124. On the periphery of said under face 122, the body 90 also has a locating profile 126 complementary to the locating profile 118 of the top edge 116 of the ring.

The locating profiles here above mentioned and visible on the figures are not further described. The person skilled in the art knowns multiple complementary profiles such as undercuts or grooves filling the desired locating function.

In the under face 122, the body 90 is further provided with a shallow circular recess 128. From the centre of the recess 128 axially X extend inside the body 90 a blind bore 130 having, proximal the recess 128, an open portion 132 of diameter D132 slightly smaller than the sleeve outer diameter D68, and, a blind end portion 134 of slightly smaller diameter than the open portion 132.

As shown on FIG. 6, the ring 88 is positioned on the baseplate 86, the locating profile 114 of the under edge of the ring being complementary engaged in the annular locating protrusion 104 of the baseplate and, the body 90 is also accurately positioned on the ring 88, the locating profile 126 of the body being complementary engaged in the locating profile 118 of the top edge of the ring. To maintain the parts together, the body 90 is welded to the ring 88 all along the circumferential parting line of said parts and, the ring 88 is welded to the baseplate 86 also all along the circumferential parting line of said parts. After the welding operation, a final manufacturing step of the diameters D98, D132, of the baseplate through hole 98 and of the open portion 132 of the bore ensures perfect concentricity between the two diameters.

The armature-and-body module 34, now described in reference to FIG. 7, is the assembly of the armature module 36 and of the body module 38. As visible on the figure, a coil spring 136 is firstly engaged and placed in the blind end portion 134 of the bore 130, the armature module 36 is then assembled by engagement of the shaft 42 in the blind bore 130, the socket flange 46 entering first with the top face 84 of the disc flange facing the blind end of the bore, then, the sleeve 44 is press-fitted in the open portion 132 of the bore, the outer diameter D68 of the sleeve being slightly larger than the inner diameter D132 of the open portion of the bore.

Here again, the person skilled in the art will easily have determined the diameter difference between the outer diameter D68 of the sleeve and the inner diameter D132 of the open portion of the bore in order ensure the required fixation of the armature module 36 into the body module 38.

The actuation module 32 is now described in reference to FIG. 1. Said module 32 comprises the assembly in a cover member 138 of a toroidal solenoid 140 to which is fixed by over moulding an electrical connector 142.

As well known, the toroidal solenoid 140 is an electrical coil having a ring shape defining a central opening, the solenoid having an outer diameter DO140 and an inner diameter DI140 slightly larger than the outer diameters D108, D120, of the ring and of the body, both outer diameters being, as already said, equal to the approximation of the necessary manufacturing tolerances.

The cover member 138 has a peripheral wall 144 defining on inner space and having a first top closed portion 146 shaped in an axial X cylindrical form for complementary receiving the top part of the magnetic cylindrical body 90, a second intermediate portion 148 having a coaxial cylindrical wall of larger diameter shaped to complementary receive the solenoid 140 and, a third open bottom portion 150 shaped for complementary engagement and fixation on the baseplate 86.

The solenoid 140 is axially arranged in the second portion 148 of the cover member 138 and, the electrical connector 142 integral to the solenoid 140 radially protrudes outside the second portion of the cover member 138, that has locally a specific aperture and specific profile accommodating said radial extension of the connector. The connector 142 is adapted to receive a complementary connector for, in use, electrically linking the solenoid 140 to an external command unit.

The finished DIV, presented on FIG. 1, is obtained by inserting the armature-and-body module 34 in the actuation module 32, the top of the body 90 being arranged in the first portion 146 of the cover member, the non-magnetic annular ring 88 being engaged inside the central opening of the solenoid and, the baseplate 86 being partially complementary engaged and fixed on the third open portion 150. The extreme part of the peripheral wall 94 of the baseplate comprising the annular under face 58 protrudes outside said cover member 138.

The operation of the DIV is now briefly presented. Arranged and fixed on the top face 24 of the fuel pump, the stem 22 of the inlet valve member axially X protrudes aligned with the DIV.

In a first phase the solenoid 140 is not energized, the coil spring 136 compressed in the blind end of the bore downwardly biases the armature module in a first position P1. The air gap A is open between the under face 70 of the sleeve and the top face 52 of the base of the armature. In such first position P1 the armature pushes on the top of the inlet valve member 18.

In a second phase the solenoid 140 is energized and it generates a magnetic field M that upwardly attracts and displaces the armature module 36 in a second position P2, further compressing the coil spring 136 in the end portion of the bore. The top face 52 of the armature comes in abutment close to the under face 70 of the sleeve and, in this second position P2 the air gap A is open between the top face 72 of the sleeve and the under face 82 of the disc flange. In this second position P2, the DIV removes efforts from the inlet valve member 18.

This brief description of the operating conditions of the DIV leads to select hard steel, such as 100Cr6 bearing steel, for making the shaft 42 and the sleeve 44. This hard steel tends to minimize the wear when alternating the between first P1 and second P2 positions and also the hammering when the head 66 of the shaft comes in abutment against the under face 70 of the sleeve or the annular protrusion 75. Also, as can be seen on the figures, the sleeve 44 has an axial height measured between the under face 70 and the top face 72 that is much larger than the guiding diameters D42, D74, of the shaft and of the sleeve, thus providing an excellent guiding function.

Also, the ring 88 as mentioned is made in a non-magnetic steel while magnetic steel are chosen for the base portion 48 of the armature and for the body member 90.

The magnetic field M generated by the solenoid 140 loops around the solenoid 140 between the cover 138, the body member 90, the sleeve 44, the armature 40 and the baseplate 86. All said components are made of magnetic material and, to optimize the operation of the DIV, the outer face 56 of the armature base portion is in close proximity with the lateral face of the baseplate through bore 98. This further explains the very accurate concentricity required between the armature baseplate 98 and the surrounding components.

Another advantage of this embodiment is that the components of the body module 38 being welded all around their periphery created a seal tight enclosure within which is arranged the actuator module 36. Then the solenoid 140 is sealed in its specific compartment between the outer faces of the body module, the inner face of the cover and the baseplate and it is not subject to any fuel contact.

Although the assembly process of the DIV has been partially described as part of the description of the product, a more detailed, step by step description of said process is now presented.

A method 200 to assemble the magnetic armature module 36 comprises the steps of:

a) providing the magnetic armature member 40 having a base member 48 and a shaft 42, b) providing the tubular cylindrical sleeve 44, c) providing the flange socket 46, d) slidably engaging the sleeve 44 on the elongated shaft 42 of the armature, the under face 70 of the sleeve facing the top face 52 of the base portion of the armature, e) press-fitting the flange socket 46 on said shaft 42 by engaging the shaft 42 through the axial opening 78 of the central portion of the socket, the under face 82 of the disc-like flange facing the top face 72 of the sleeve, f) adjusting the position of the socket 46 on the shaft 42 so that a predetermined air-gap A is kept open between the under face 82 of the flange and the top face 72 of the sleeve or, between the under face 70 of the sleeve and the top face 52 of the armature member base portion.

A method 202 to assemble an armature-and-body module 34 comprises the steps of:

g) providing the armature module 36 assembled as per the above method 200, h) providing the body module 38, i) assembling an armature-and-body module 34 arrangement by:

j) presenting the armature module 36 before the body module 38, the shaft 42 being axially aligned with the blind bore 130, the spring seat 46 being proximal to the blind bore opening 134, k) engaging the armature module 36 by freely entering the spring seat 46 in the bore 130, then by press-fitting with interference the sleeve 44 in the bore 130 so that, the coil spring 136 is axially compressed between the blind end 134 of the bore and the spring seat 46, the coil spring biasing the armature module 36 in the first extreme position P1.

A method 204 to assemble the DIV 30 comprises the steps of:

l) providing an armature-and-body module 34 assembled as per the above method 202, m) providing the actuation module 32, n) presenting the armature-and-body module 34 before the actuation module 32, the magnetic cylindrical body 90 facing the open bottom portion of the cover member, o) engaging the armature-and-body module 34 into the actuation module 32, the magnetic cylindrical body 90 being adjusting in the first top closed portion 146 of the cover member and, the non-magnetic ring 88 adjusting in the central opening of the toroidal solenoid 140.

LIST OF REFERENCES

X pumping axis
OS open state of the inlet valve member
CS closed state of the inlet valve
A air gap
M magnetic field
D42 diameter of the shaft
D56 diameter of the outer face of armature base portion
D64 diameter of the through bore in the armature
D66 diameter of the head of the shaft
D68 outer diameter of the sleeve
D74 diameter of the sleeve guiding bore
D78 diameter of the through opening D80 outer diameter of the disc-like flange
D98 diameter of the through hole in the baseplate
D108 outer diameter of the ring
D110 inner diameter of the ring
D120 outer diameter of the body
D132 diameter of the open portion of the bore
DO140 outer diameter of the solenoid
DI140 inner diameter of the solenoid
10 fuel pump
12 pump inlet
14 compression chamber
16 pump outlet
18 inlet valve member
20 head of the poppet inlet valve member
22 stem of the poppet inlet valve member
24 top face of the pump
26 valve spring
28 spring seat
30 digital inlet valve—DIV
32 actuation module
34 armature-and-body module
36 armature module
38 body module
40 magnetic armature
42 elongated shaft
44 sleeve
46 flange socket forming spring seat
48 cup-like cylindrical magnetic base portion
50 top wall of the armature
52 transverse top face
54 peripheral cylindrical wall
56 outer face
58 annular under face
60 recess
62 bottom face of the recess
64 bore in the armature
65 channels
66 head of the shaft
68 outer cylindrical face of the sleeve
70 under face of the sleeve
72 top face of the sleeve
74 guiding bore provided in the sleeve
76 cylindrical central portion of the spring seat
78 through opening in the spring seat
80 disc-like flange
82 under face of the flange
83 top portion of the shaft
84 top face of the flange
85 shoulder face on the shaft
86 baseplate
88 non-magnetic annular ring
90 magnetic cylindrical body
92 transverse planar wall of the baseplate
94 peripheral small wall of the baseplate
96 location face of the baseplate
98 through hole in the baseplate
100 under face of the transverse wall
102 top face of the transverse wall
104 annular locating protrusion
106 cylindrical wall of the annular ring
108 outer face of the wall of the ring
110 inner face of the wall of the ring
112 under edge of the ring
114 profile of the under edge
116 top edge of the ring
118 profile of the top edge
120 outer face of the body
122 under face of the body
124 top face of the body
126 locating profile of the body
128 shallow recess in the body
130 blind bore in the body
132 open portion of the bore
134 blind end portion of the bore
136 coil spring
138 cover member
140 solenoid
142 electrical connector
144 peripheral wall of the cover member
146 first top closed portion of the cover member
148 second intermediate portion of the cover member
150 third open portion of the cover member
200 method to assemble the armature module
202 method to assemble the armature-and-body module
204 method to assemble the DIV
a)-o) method steps

The invention claimed is:

1. A magnetic armature module of a digital inlet valve (DIV), the DIV also having a body module and an actuation module, the magnetic armature module, the body module, and the actuation module forming the DIV and cooperating, in use, with an inlet valve member of a fuel pump, the inlet valve member commuting between an open state and a closed state to control fuel inlet into a compression chamber of the fuel pump, the magnetic armature module comprising:

a magnetic armature member having a cylindrical base portion and an elongated shaft, the elongated shaft protruding from a top face of the cylindrical base portion and extending along a main axis toward a distal end;

a tubular cylindrical sleeve having an outer cylindrical face axially extending from an under face to a top face of the tubular cylindrical sleeve, the tubular cylindrical sleeve also having an axial through bore opening in both the under face and the top face of the tubular cylindrical sleeve, the tubular cylindrical sleeve being slidably arranged on the elongated shaft engaged in the axial through bore, the under face of the tubular cylindrical sleeve facing the top face of the cylindrical base portion of the magnetic armature member, a flange socket forming a spring seat provided with a disc-like flange portion radially extending from a central portion provided with an axial opening engaged and fixed on the elongated shaft, the disc-like flange portion radially extending from the elongated shaft and having an under face facing the top face of the tubular cylindrical sleeve and also having a top face adapted to receive a coil spring;

wherein the flange socket is fixed in a position enabling the tubular cylindrical sleeve to freely translate along the elongated shaft between a first extreme position where the under face of the the tubular cylindrical sleeve abuts proximal to the top face of the cylindrical base portion and, a second extreme position where the top face of the tubular cylindrical sleeve abuts proximal to the under face of the disc-like flange portion.

2. A magnetic armature module as claimed in claim 1, wherein the elongated shaft is provided with a top portion having a reduced diameter which creates a shoulder face against which the flange socket is positioned in abutment.

3. A magnetic armature module as claimed in claim 1, wherein the flange socket is an interference fit on the elongated shaft.

4. A magnetic armature module as claimed in claim 1, wherein the cylindrical base portion and the elongated shaft are separate components, the elongated shaft being fixed onto the cylindrical base portion.

5. A magnetic armature module as claimed in claim 1, wherein the magnetic armature member is monobloc, the elongated shaft being integral to the cylindrical base portion.

6. A body module of a digital inlet valve (DIV), the DIV also having an actuation module and a magnetic armature module, the magnetic armature module being as set forth in claim 1, the magnetic armature module, the body module, and the actuation module forming the DIV and cooperating, in use, with an inlet valve member of a fuel pump, the inlet valve member commuting between an open state and a closed state to control fuel inlet into a compression chamber of the fuel pump, the body module comprising:

a baseplate member having a transverse planar wall surrounded by a peripheral small wall, the transverse planar wall being provided with an axial through hole opening in an under face and in an opposed top face of the transverse planar wall and, the peripheral small wall being adapted to position the DIV on a top face of the fuel pump, the under face of the transverse planar wall facing the top face of the fuel pump and, the inlet valve member axially protruding out of the top face of the fuel pump;

a non-magnetic tubular ring having a cylindrical wall with an outer face and an inner face defining a central cylindrical passage, the cylindrical wall axially extending from an under edge to a top edge, the under edge being fixed to the baseplate member so the axial through hole of the baseplate member is aligned with the central cylindrical passage of the non-magnetic tubular ring; and a magnetic cylindrical body having an outer cylindrical face axially extending from an under face to a top face, and being provided with an axial blind bore opening in the under face of the outer cylindrical face and axially extending inside the magnetic cylindrical body toward a bottom end proximal to the top face of the outer cylindrical face, the under face of the outer cylindrical face being fixed to the top edge of the non-magnetic tubular ring so that the axial blind bore is axially aligned with the axial through hole of the baseplate member and the central cylindrical passage of the non-magnetic tubular ring.

7. A body module as claimed in claim 6, wherein the outer cylindrical face of the magnetic cylindrical body is in flush continuity with the outer face of the cylindrical wall of the non-magnetic tubular ring.

8. A body module as claimed in claim 6, wherein the baseplate member, the non-magnetic tubular ring and the magnetic cylindrical body are welded to each other.

9. An armature-and-body module of a digital inlet valve (DIV) cooperating, in use, with an inlet valve member of a fuel pump, the inlet valve member commuting between an open state and a closed state to control fuel inlet into a compression chamber of the fuel pump, the armature-and-body module comprising:

1) a magnetic armature module comprising:

a magnetic armature member having a cylindrical base portion and an elongated shaft, the elongated shaft protruding from a top face of the cylindrical base portion and extending along a main axis toward a distal end;

a tubular cylindrical sleeve having an outer cylindrical face axially extending from an under face to a top face of the tubular cylindrical sleeve, the tubular cylindrical sleeve also having an axial through bore opening in both the under face and the top face of the tubular cylindrical sleeve, the tubular cylindrical sleeve being slidably arranged on the elongated shaft engaged in the axial through bore, the under face of the tubular cylindrical sleeve facing the top face of the cylindrical base portion of the magnetic armature member, a flange socket forming a spring seat provided with a disc-like flange portion radially extending from a central portion provided with an axial opening engaged and fixed on the elongated shaft, the disc-like flange portion radially extending from the elongated shaft and having an under face facing the top face of the tubular cylindrical sleeve and also having a top face adapted to receive a coil spring;

wherein the flange socket is fixed in a position enabling the tubular cylindrical sleeve to freely translate along the elongated shaft between a first extreme position where the under face of the the tubular cylindrical sleeve abuts proximal to the top face of the cylindrical base portion and, a second extreme position where the top face of the tubular cylindrical sleeve abuts proximal to the under face of the disc-like flange portion; and 2) a body module comprising:

a baseplate member having a transverse planar wall surrounded by a peripheral small wall, the transverse planar wall being provided with an axial through hole opening in an under face and in an opposed top face of the transverse planar wall and, the peripheral small wall being adapted to position the DIV on a top face of the fuel pump, the under face of the transverse planar wall facing the top face of the fuel pump and, the inlet valve member axially protruding out of the top face of the fuel pump;

a non-magnetic tubular ring having a cylindrical wall with an outer face and an inner face defining a central cylindrical passage, the cylindrical wall axially extending from an under edge to a top edge, the under edge being fixed to the baseplate member so the axial through hole of the baseplate member is aligned with the central cylindrical passage of the non-magnetic tubular ring; and a magnetic cylindrical body having an outer cylindrical face axially extending from an under face to a top face, and being provided with an axial blind bore opening in the under face of the outer cylindrical face and axially extending inside the magnetic cylindrical body toward a bottom end proximal to the top face of the outer cylindrical face, the under face of the outer cylindrical face being fixed to the top edge of the non-magnetic tubular ring so that the axial blind bore is axially aligned with the axial through hole of the baseplate member and the central cylindrical passage of the non-magnetic tubular ring;

wherein the coil spring is arranged in the axial blind bore proximal the bottom end of the axial blind bore; and wherein the tubular cylindrical sleeve is inserted and fixed in the axial blind bore of the magnetic cylindrical body so that the coil spring is axially compressed in the axial blind bore between the bottom end of the axial blind bore and the flange socket, the coil spring biasing the magnetic armature module in the second extreme position.

10. An armature-and-body module as claimed in claim 9, wherein the tubular cylindrical sleeve is an interference fit in the axial blind bore.

11. An actuation module of a DIV adapted to cooperate in use with an armature-and-body module assembly, the armature-and-body module assembly being as set forth in claim 9, the actuation module comprising:

an electrical solenoid fixed and enclosed inside a cover member, the electric solenoid generating, in use when energized, a magnetic field adapted to attract and to displace the magnetic armature member.

12. An actuation module as claimed in claim 11, wherein the electric solenoid is toroidal defining a central opening adapted to be engaged over the body module, the non-magnetic tubular ring being inside the central opening of the electric solenoid.

13. An actuation module as claimed in claim 11 wherein, a wall of the cover member defines a multi-portion internal space adapted to receive the body module, a first top closed portion being shaped to complementary receive the magnetic cylindrical body, a second intermediate portion being shaped to complementary receive the electric solenoid and, a third open bottom portion being shaped for complementary engagement and fixation on the baseplate member.

14. A digital inlet valve (DIV) comprising an armature-and-body module, the armature-and-body module being as set forth in claim 9, the armature-and-body module being enclosed inside an actuation module, the actuation module being as set forth in claim 13, wherein the non-magnetic cylindrical ring is centrally arranged in the electric solenoid and, the open bottom third portion of the cover member complementary arranged with the baseplate member so that, in use, the DIV is able to bias open the inlet valve member by having the armature module in the first position and, when the solenoid is energized, the magnetic field attracts the magnetic armature module in the second extreme position further compressing the coil spring, the DIV enabling fuel inlet to close to the compression chamber.

15. A method to assemble a magnetic armature module, the magnetic armature module being as set forth in claim 1, the method comprising the steps of:

a) providing the magnetic armature member;

b) providing the tubular cylindrical sleeve;

c) providing the flange socket;

d) slidably engaging the tubular cylindrical sleeve on the elongated shaft of the magnetic armature member, the under face of the outer cylindrical face of the tubular cylindrical sleeve facing the top face of the base portion of the cylindrical base portion of the magnetic armature member, e) press-fitting the flange socket on said shaft by engaging the shaft through the axial opening of the central portion of the socket, the under face of the disc-like flange facing the top face of the sleeve, f) adjusting the position of the socket on the elongated shaft so that a predetermined air-gap is kept open between the under face of the disc-like flange portion and the top face of the tubular cylindrical sleeve or, between the under face of the tubular cylindrical sleeve and the top face of the cylindrical base portion of the magnetic armature member.

16. A method to assemble an armature-and-body module, the armature-and-body module being as set forth in claim 15, the method comprising the steps of:

g) providing a magnetic armature module assembled as per the method set forth in claim 15, h) providing a body module as claimed in claim 8, i) assembling the armature-and-body module arrangement by:

j) presenting the magnetic armature module before the body module, the elongated shaft being axially aligned with the axial blind bore, the flange socket being proximal to the blind bore, k) engaging the magnetic armature module by freely entering the flange socket in the axial blind bore, then by press-fitting with interference the tubular cylindrical sleeve in the axial blind bore so that, the coil spring is axially compressed between the bottom end of the axial blind bore and the flange socket, the coil spring biasing the magnetic armature module in the first extreme position.

17. A method to assemble a DIV, the DIV being as set forth in claim 14, the method comprising the steps of:

l) providing an armature-and-body module assembled as per the method claimed in claim 16, m) providing an actuation module as claimed in claim 13, n) presenting the armature-and-body module before the actuation module, the magnetic cylindrical body facing the open bottom third portion of the cover member, o) engaging the armature-and-body module into the actuation module, the magnetic cylindrical body adjusting in the first top closed portion of the cover member and, the non-magnetic tubular ring adjusting in the central opening of the toroidal solenoid.

* * * * *